United States Patent [19]

Pai et al.

[11] Patent Number: 4,457,994

[45] Date of Patent: Jul. 3, 1984

[54] PHOTORESPONSIVE DEVICE CONTAINING ARYLMETHANES

[75] Inventors: Damodar M. Pai, Fairport; John F. Yanus, Webster, both of N.Y.

[73] Assignee: Xerox Corporation, Stamford, Conn.

[21] Appl. No.: 440,782

[22] Filed: Nov. 10, 1982

[51] Int. Cl.[3] ..... G03G 5/10

[52] U.S. Cl. ..... 430/59; 430/64; 430/66

[58] Field of Search ..... 430/58, 59, 64, 66

[56] References Cited

U.S. PATENT DOCUMENTS

| | | | |
|---|---|---|---|
| 4,050,935 | 9/1977 | Limburg et al. | 430/58 |
| 4,078,925 | 3/1978 | Horgan | 430/58 |
| 4,301,226 | 11/1981 | Contois | 430/72 |

*Primary Examiner*—John E. Kittle
*Assistant Examiner*—John L. Goodrow
*Attorney, Agent, or Firm*—E. O. Palazzo

[57] ABSTRACT

An improved layered photoresponsive device comprised of a substrate, a photogenerating layer, comprised of inorganic photoconductive composition, or an organic photoconductive composition, a charge carrier transport layer in contact with the photogenerating layer, which transport layer is comprised of electrically active molecules of the formula:

dispersed in a highly insulating and transparent organic resinous material, wherein X is selected from the group consisting of (ortho) $CH_3$, (meta) $CH_3$, (para) $CH_3$, (ortho) Cl, (meta) Cl, (para) Cl; and as a top coating in contact with the charge carrier transport layer, an arylmethane of the formula:

wherein $R_1$ and $R_2$ are independently selected from the group consisting of alkyl groups, aryl groups, alkylaryl groups and arylalkyl groups, $R_3$ is independently selected from the group consisting of hydrogen, and methyl, $R_4$ is independently selected from the group consisting of alkyl groups, alkylaryl groups, arylalkyl groups, and a disubstituted aminophenyl group, wherein the substituents are independently selected from the group consisting of alkyl, aryl, alkylaryl, and arylalkyl, as well as the use of such devices in electrostatic latent imaging systems.

17 Claims, 1 Drawing Figure

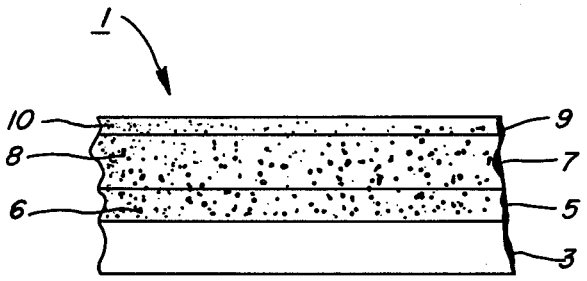
1
10
8
6
9
7
5
3

PHOTORESPONSIVE DEVICE CONTAINING ARYLMETHANES

BACKGROUND

This invention is generally directed to improved photoresponsive devices, and more specifically the present invention is directed to an improved photoresponsive imaging member containing as an overcoating layer arylmethanes, such as bis-(4-diethylamino-2-methylphenyl)-phenylmethane. The improved photoresponsive imaging member of the present invention, which also contains a photogenerating layer, and charge transport layer, is useful in electrostatographic imaging systems, including xerographic imaging systems, wherein latent electrostatic latent images are formed on the member, followed by development of the image, and subsequent transfer to a suitable substrate.

A number of photoresponsive imaging members, which are useful in electrostatic imaging systems are known. One such member is comprised of a conductive substrate containing on its surface a layer of photoconductive insulating material, such as amorphous selenium. In some instances, there can be situated between the substrate and the amorphous selenium a thin barrier layer of aluminum oxide, for the purpose of preventing charge injection from the substrate into the selenium upon charging of the plate surface. Other inorganic photoresponsive materials are known including, for example, alloys of selenium, such as arsenic selenium, selenium arsenic tellurium, and mixtures of selenium with other substances. Also recently, there has been disclosed organic photosensitive materials, wherein the charge carrier generating function, and the charge carrier transport function, are accomplished by discrete contiguous layers. Moreover, photoreceptors are known which include an overcoating layer of an electrically insulating polymeric material, and in conjunction with this overcoated type photoreceptor, there have been proposed a number of imaging methods. However, the art of xerography continues to advance and more stringent demands need to be met by the copying apparatus in order that performance standards may be increased primarily for the purpose of obtaining higher quality images. Also, there are needed protective layers for photoresponsive devices in order to prevent these devices from degrading under cyclic conditions.

There is disclosed in U.S. Pat. No. 3,041,167 an electrophotographic imaging member comprised of a conductive substrate, a photoconductive insulating layer, and an overcoating layer of an electrically insulating polymeric material. This member can be selected for use in electrophotographic imaging methods where the member is, initially charged with electrostatic charge of a first polarity, and imagewise exposed to form an electrostatic latent image, which can then be transferred to form a visible image after development.

Disclosed in U.S. Pat. No. 4,265,990 are organic layered photoresponsive devices comprised of a substrate, a generating layer, and a transport layer. Examples of generating layers include inorganic photoconductive materials such as triganol selenium, and organic photoconductive materials such as metal phthalocyanines, metal free phthalocyanines, and vanadyl phthalocyanine, while examples of carrier transport layers include certain diamines dispersed in a resin binder, the diamines being of the formula as shown, for example, in the '990 patent. Additionally disclosed in U.S. Pat. No. 4,059,935 a photosensitive member having at least two electrically operative layers, the first layer containing trigonal selenium and the second layer containing a contiguous charge transport layer comprised of a transparent electrically inactive organic resinous material containing from about 15 to about 75 percent by weight of a bis-(4-diethylamino-2-methylphenyl)-phenylmethane. The use of the bis-(4-diethylamino-2-methylphenyl)-phenylmethane compound as an overcoating for a photoresponsive device is, however, not disclosed in this patent.

Although the photoresponsive devices described in the prior art are effective for their intended purposes, there continues to be a need for, improved photoresponsive devices. Further, some of the prior art photoresponsive imaging devices, particularly those comprised of transport and generating layers, may suffer deficiencies during the cleaning processing sequence. In this sequence, it is believed that the charge carrier transport layers containing the diamines of the '990 patent may be susceptible to unpredictable positive charge acceptance, from a positive charging precleaning corotron device. This results primarily from the degradation of the top layer portions of the diamine transport layer, which in turn causes positive charges to be injected from the top surface of the device into other layers, resulting in low and unpredictable positive charge acceptance for this device. Accordingly, this unpredictable positive charge acceptance following cleaning would cause variations in negative charges subsequently applied to the device, causing fluctuations in image densities. Another problem encountered with the degradation of the top layer portions of the diamine transport layer relate to loss of image resolution, since the diamines after degradation from corona effluents and the like become conductive. While it is not believed that the surface of the triphenylmethane transport layers of the '935 patent become conductive because of degradation, the bulk of these layers are susceptible to charge trapping caused by degradation, which trapping causes a residual potential to form after each charge exposure step in the image cycle. This accumulation of residual potential on the photoresponsive device causes an increase in the background density of the resulting images.

SUMMARY OF THE INVENTION

It is an object of the present invention to provide an improved photoresponsive imaging device which overcomes the above-noted disadvantages.

Another object of the present invention is the provision of an improved layered photoresponsive device containing a photogenerating layer and a charge transport layer.

It is another object of the present invention to provide an improved photoresponsive imaging device, containing in contact with a transport layer an overcoating layer of arylmethane, such as bis-(4-diethylamino-2-methylphenyl)-phenylmethane.

These and other objects of the present invention are accomplished by the provision of a photoresponsive device containing a photogenerating layer, a charge transport layer, and as an overcoating layer, an arylmethane composition. More specifically, in one embodiment, the present invention is directed to an improved layered photoresponsive imaging device comprised of (1) a substrate, (2) a photogenerating layer, (3) a charge carrier transport layer, and (4) an arylmethane overcoating layer.

BRIEF DESCRIPTION OF THE DRAWINGS

For a better understanding of the present invention and further features thereof, reference is made to the following detailed description of various preferred embodiments wherein:

FIG. 1 is a partially schematic cross sectional view of the photoresponsive device of the present invention.

DESCRIPTION OF THE PREFERRED EMBODIMENT

Illustrated in FIG. 1 is the photoresponsive device of the present invention, generally designated 1, comprising a substrate 3, a layer 5 containing a photoconductive charge carrier generating material, optionally dispersed in a resinous binder 6, a layer 7 containing a charge carrier transport material, dispersed in a inactive resinous binder 8, and an overcoating layer 9 containing an arylmethane, such as bis-(4-diethylamino-2-methylphenyl)-phenylmethane dispersed in a resinous binder material 10.

Substrate 3 may be opaque or substantially transparent and may be comprised of numerous known suitable materials having the requisite mechanical properties. Accordingly, the substrate may comprise a layer of non-conductive material such as an inorganic or organic polymeric material; a layer of an organic or inorganic material having a conductive surface layer arranged thereon, or a conductive material including aluminum, steel, brass, graphite, dispersed conductive salts, conductive polymers and the like. The substrate may be flexible or rigid, or may have any of a number of different configurations such as, for example, a plate, a cylindrical drum, a scroll, a flexible belt, and the like. Also, the substrate or support may comprise a composite structure such as a thin conductive coating contained on a paper base, a plastic coated with a thin conductive layer such as aluminum or copper iodide, or glass coated with a thin conductive coating of chromium or tin oxide. One preferred substrate, however, is comprised of aluminized Mylar, commercially available from the Hi-Sil Company.

The thickness of the support layer 3 depends on many factors including economical considerations, thus, this layer may be of substantial thickness, for example, over 5 mils or of a minimum thickness, for example as low as 1 mil, provided there are no adverse affects imparted to the photoresponsive imaging device. In one preferred embodiment, the thickness of the substrate layer 3 ranges from about 1 mil to about 5 mils.

The photoconductive charge carrier generating layer 5 may be comprised of various photoconductive generating material known for use in electrophotography providing they are electrically compatible with the charge carrier transport layer 7, that is that they can inject photoexcited charge carriers into the transport layer. Photoconductive materials that can be utilized in the charge carrier photogenerating layer 5 include both inorganic photoconductive substances and organic photoconductive substances. Examples of inorganic photoconductive substances include amorphous selenium, selenium alloys such as selenium tellurium, selenium arsenic, selenium tellurium arsenic, cadmium sulfoselenide, cadmium selenide, cadmium sulfide, and mixtures thereof. Selenium can also be employed in its crystalline form known as trigonal selenium. Illustrative examples of organic photoconductive materials selected for the photogenerating layer 5 include metal and metal free phthalocyanines, including, for example, the X form of phthalocyanine; copper phthalocyanine, and vanadyl phthalocyanine. The preferred photoconductive materials or pigments for this layer are trigonal selenium, vanadyl phthalocyanine, and alloys of selenium and arsenic.

The photogenerating layer 5 may be comprised entirely of the photoconductive generating materials disclosed herein, however, this layer can also contain these materials dispersed in a resinous polymeric binder. As a dispersion, the photoconductive generating materials are present in an amount of from about 5 percent by volume to about 75 percent by volume, and preferably from about 7 percent by volume to about 40 percent by volume. Examples of binder materials that can be selected for this layer include those which are substantially inactive such as polyesters, polyamides, polyurethanes, polycarbonates, phenoxy rsins, epoxy resins, mixturs thereof, and the like. In preferred embodiments, the photogenerating layer 5 contains trigonal selenium, 15 percent by volume, dispersed in a poly n-vinyl carbazole binder material; vanadyl phthalocyanine dispersed in a polycarbonate resinous binder; or a single uniform layer of an amorphous selenium-arsenic-tellurium alloy.

Generally, the photogenerating layer 5 ranges in thickness of from about 0.02 microns to about 10 microns, and preferably is of a thickness of from about 0.1 microns to about 2 microns. Normally, it is desired to provide this layer in a thickness which is sufficient to absorb at least 75 percent or more of the incident radiation which is directed upon it in an imagewise exposure step. The maximum thickness is dependent primarily on factors such as mechanical consideration, for example, whether a flexible photoreceptor is desired.

The charge transporting layer 7 can be comprised of a number of numerous suitable materials which are capable of transporting holes, this layer generally having a thickness in the range of from about 2 microns to about 50 microns, and preferably from about 10 microns to about 30 microns. In one embodiment of the present invention, charge carrier transport layer 7 comprises molecules of the formula:

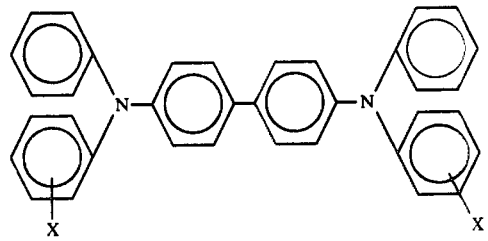

dispersed in a highly insulating and transparent organic resinous material 8, wherein X is selected from the group consisting of (ortho) $CH_3$, (meta) $CH_3$, (para) $CH_3$, (ortho) Cl, (meta) Cl, (para) Cl. This charge transport layer, which is described in detail in U.S. Pat. No. 4,265,990, is substantially non-absorbing in the spectral region of intended use, visible light, but is "active" in that it allows injection of photogenerated holes from the charge generator layer.

The highly insulating resin 8, which has a resistivity of at least $10^{12}$ ohm-cm to prevent undue dark decay, is a material which is not necessarily capable of supporting the injection of holes from the generator layer, and is not capable of allowing the transport of these holes through the transport layer. However, the resin becomes electrically active when it contains from about 10 to 75 weight percent of the substituted N,N,N',N'-tetraphenyl[1,1-biphenyl]4-4'-diamines corresponding to the foregoing formula. Compounds corresponding to this formula include, for example, N,N'-diphenyl-N,N'-bis(alkylphenyl)-[1,1-bisphenyl]-4,4'-diamine wherein the alkyl is selected from the group consisting of methyl such as 2-methyl, 3-methyl and 4-methyl, ethyl, propyl, butyl, and the like. With chloro substitution, the compound is N,N'-diphenyl-N,N'-bis(halo phenyl)-[1,1'-biphenyl]-4,4'-diamine, wherein the halo is 2-chloro, 3-chloro or 4-chloro.

Other electrically active small molecules which can be dispersed in the electrically inactive resin 8 to form a layer which will transport holes include N,N'-diphenyl-N,N'-bis(3-methylphenyl)-[p-terphenyl]-4,4''-diamine, N,N'-diphenyl-N,N'-bis(phenylmethyl)-[1,1'-biphenyl]-4,4'-diamine, and the like.

Transport layer 7 may contain various transparent electrically inactive binder resinous materials 8, such as those described in U.S. Pat. No. 3,121,006, the disclosure of which is totally incorporated herein by reference. The resinous binder contains from about 10 to about 75 weight percent of the active transport material corresponding to the foregoing formula, and preferably from about 40 to about 50 weight percent of this material. Typical organic resinous materials useful as binder 8, include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight (Mw) of from about 20,000 to about 100,000 with a molecular weight in the range of from about 50,000 to about 100,000 being particularly preferred.

The overcoating layer 9 which is in a thickness of from about 0.01 microns to about 20 microns, and preferably is of a thickness of from about 0.01 microns to about 5 microns, is comprised of an arylmethane compound of the following formula:

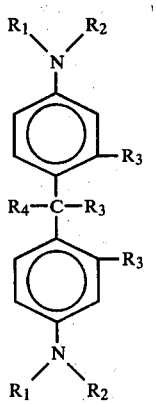

wherein $R_1$ and $R_2$ are independently selected from the group consisting of alkyl groups, aryl groups, alkylaryl groups and arylalkyl groups, $R_3$ is independently selected from the group consisting of hydrogen, and methyl, $R_4$ is independently selected from the group consisting of alkyl groups, alkylaryl groups, arylalkyl groups, and a disubstituted aminophenyl group, wherein the substituents are independently selected from the group consisting of alkyl, aryl, alkylaryl, and arylalkyl. Generally, the alkyl groups contain from about 1 carbon atom to about 8 carbon atoms, including, for example, methyl, ethyl, propyl, butyl, pentyl, hexyl, heptyl, and octyl, while the aryl groups are phenyl groups, or a condensated ring group such as naphthalene.

Illustrative examples of arylmethanes included within the above-identified formula are bis-(4-N,N'-diethylamino-2-methylphenyl)phenylmethane, 1-bis-(4-N,N'-diethylaminophenyl-1-phenylethane, bis[(4-bis-N,N'-phenylmethyl)-amino-2-chlorophenyl]phenylmethane, and the like. The preferred arylmethane for overcoating layer 10 is comprised of bis-(4-N,N'-diethylamino-2-methylphenyl)phenylmethane.

The overcoating arylmethane layer can contain the appropriate methane dispersed in the inactive polymeric resinous binder 10 in an amount of from about 25 percent by weight to about 95 percent by weight, and preferably in an amount of from about 50 percent by weight to about 90 percent by weight. Examples of inactive polymeric resinous binders include polyester materials, polycarbonate materials, phenoxy resins, epoxy resins, mixtures thereof, and the like.

Although it is not desired to be limited by theory, it is believed that the overcoating layer 9 prevents degradation of the other layers in the device, and in particular the charge carrier transport layer 7. In the absence of this overcoating layer, the surface region of the transport layer 7 becomes conductive when repeatedly subjected to a charge, exposure, and erasure cycle, which conductivity limits the resolution of images produced on devices containing these materials. Also, the positive charge acceptance of the device in the absence of layer 10 is unpredictable, as positive charges generated by the positive charging pre-cleaning corotron when followed by a negative charging step for the next imaging cycle, causes electrical instabilities in the photoresponsive device. In contrast, with the arylmethane overcoating layer 9 of the present invention, the charge transport layer does not become conductive on repeated charge, exposure, and erasure cycles, and therefore, provides an ideal surface for image production. Additionally, as the arylmethane of the present invention is used only in the top regions of the device, and not in the bulk layers thereof, any charge trapping that occurs, is confined to a narrow region within layer 9, and therefore does not cause residual and cycle up formed in devices containing transport layers of bis-(4-N,N'-diethylamino-2-methylphenyl)phenylmethanes.

In a further modification of the layered structure of the present invention, as described in FIG. 1, there can be included the use of a blocking layer at the substrate photoconductive interface, that is between the support layer 3 and the photogenerating layer 5, which blocking layer functions to prevent the injection of charge carriers from the substrate into the hole generating layer such as trigonal selenium. Various suitable blocking materials may be used, including, for example, nylon, epoxy resins and aluminum oxide.

The improved photoresponsive device of the present invention can be incorporated in numerous electrostatographic systems including xerography, wherein electrostatic latent images formed on the device are developed by various suitable techniques including cascade development, magnetic brush development, liquid development and the like. Subsequent to development, the visible image is transferred to a receiving member by any conventional transfer technique and affixed thereto. While it is preferred to develop the electrostatic latent image with marking materials including developer compositions containing toner particles, and carrier particles, the image may be used in a host of other ways, for example, the latent image can be read with an electrostatic scanning system. Additionally, the photoresponsive device of the present invention can be used to make additional reproductions, as in the recyclicable xerographic apparatus, wherein any residual charge remaining on the device after the visible image has been transferred to a receiving member is typically removed therefrom prior to each repetition of the cycle, as are any residual toner particles remaining after the transfer step. Generally, the residual charge can be easily removed from the photoreceptor by inionizing the air above the top coating 9 while the photoconductive charge generating layer is uniformly illuminated and grounded. For example, charge removal can be effected by AC corona discharge in the presence of illumination from a light source or preferably a grounded conductive brush could be brought into contact with the surface of the device in the presence of such illumination. This latter step will also remove any residual toner particles remaining on the surface of the photoresponsive device.

The invention will now be described in detail with respect to specific preferred embodiments thereof, it being understood that these Examples are intended to be illustrative only, and the invention is not intended to be limited to the materials, conditions, process parameters, recited herein. All parts and percentages are by weight unless otherwise indicated.

EXAMPLE I

There is prepared in the following manner a photoresponsive layered device containing a substrate, a photogenerating layer and a charge transport layer.

A 1 micron layer of amorphous selenium is vacuum deposited on an aluminum substrate, having a thickness of 3 mils, which deposition was accomplished in accordance with the process details as described in U.S. Pat. Nos. 2,753,278 and 2,790,907, the disclosure of each of these patents being totally incorporated herein by reference. Prior to the deposition of the amorphous selenium, a thin, approximately 0.5 micron layer of an epoxy phenolic resinous material, commercially available from Union Carbide, barrier layer is dip coated on the aluminum substrate. This layer functions as a blocking adhesive layer, for the aluminum. There is then coated over the photogenerating layer of amorphous selenium, using a Bird film applicator, a mixture of a charge transport layer, containing 10 grams of N,N'-diphenyl-N,N'-bis(3-methylphenyl)-[1,1'-biphenyl]-4,4'-diamine, and 10 grams of a polycarbonate binder material, commercially available as Makrolon®, dissolved in 135 grams of methylene chloride. A 25 micron thick transport layer containing 50 percent by weight of the above diamine, dispersed in 50 percent by weight of the Makrolon polycarbonate, is thus formed on the photogenerating layer after drying. The resulting photoresponsive device is then evacuated at 40° C. in a vacuum for 18 hours.

An evaluation is then accomplished for the purpose of determining the capability of this device to form a latent image by charging the device to a negative polarity corona of 7,000 volts.

The charge acceptance is satisfactory in that 1,800 volts were accepted, as measured by a capacitively coupled voltmeter. The device is found to discharge efficiently when exposed to a light flash of visible radiation of 4,330 Angstrom wavelengths, and 20 ergs/cm$^2$ intensity. However, the device when charged positively, 7,000 volts, accepts only 200 volts and the dark decay is high, about 100 volts per second. The low charge acceptance indicates the presence of a conductive species on the surface of the device. On cleaning the top surface with 2-propanol, the charge acceptance improved appreciably, to 1,200 volts, indicating the partial removal of the material responsible for the low charge acceptance.

EXAMPLE II

The procedure of Example I is repeated with essentially the same device prepared with the exception that there is included thereover, an additional layer, that is an overcoating layer, in a thickness of 1 micron, of 50 percent by weight of bis-(4-N,N'-diethylamino-2-methylphenyl)phenylmethane, dispersed in a polycarbonate resinous binder, 50 percent by weight. This overcoating layer is coated on the charge transport diamine layer. This is accomplished by dissolving in 135 grams methylene chloride, 10 grams of phenylmethane, 10 grams of a polycarbonate, commercially available as Makrolon, followed by overcoating this mixture with a Bird applicator on the charge carrier transport layer. Subsequent to coating, the device is heated in a vacuum at 40° C. for 16 hours. The device is then xerographically tested by negatively charging the device to 1,800 volts. The device discharged effectively when exposed to the visible light flash of Example I. The positive charge acceptance of this photoresponsive device when charged positively to 7,000 volts is 1,200 as measured by a capacitively coupled voltmeter indicating the absence of a conductive species present with the device of Example I.

EXAMPLE III

The devices as prepared in Examples I and II are then exposed to corona effluents by placing the device under negative corona for 15 minutes. Upon xerographically testing, the positive charge acceptance of device 1 was close to zero (0), indicating the appearance of a conductive species on the surface, while the positive charge acceptance of the device for Example II was 1,000 volts.

The photoresponsive device prepared in accordance with Example I with no phenylmethane overcoating subsequent to corona exposure, was incorporated into a Xerox Corporation Model D image processor and after development resulted in images of very poor resolution. In contrast, the photoresponsive device prepared in accordance with Example II, and containing the phenylmethane overcoating was incorporated into a Xerox Corporation Model D image processor, and after development produced images of superior resolution in comparison to those obtained with the photoresponsive device of Example I.

EXAMPLE IV

The procedure of Example II is repeated, and a substantially identical device is prepared with the exception that the device was overcoated with a thin layer, 0.5 microns, 1:1 by weight of 1-bis-(4-dimethylamino-phenyl)-1-phenylethane, and polycarbonate, commercially available as Makrolon, instead of 50 percent by weight of bis-(4-N,N'-diethylamino-2-methylphenyl)-phenylmethane dispersed in 50 percent by weight of a polycarbonate binder. The device is then evacuated in a vacuum at 40° C. for 16 hours. Upon xerographic testing, negative charge acceptance and discharge are similar to that observed for the device in Example I. However, the positive charge acceptance was satisfactory, 1,200 volts, with low discharge rates, as compared to the device in Example I. On exposing to corona effluents for 15 minutes, the positive charge acceptance for the device of this Example dropped only to 1,000 volts, whereas for the device of Example I, no overcoating, the positive charge acceptance was close to zero.

Although the invention has been described with reference to specific preferred embodiments, it is not intended to be limited thereto, rather those skilled in the art will recognize variations and modifications may be made therein which are within the spirit of the invention and within the scope of the following claims.

We claim:

1. An improved layered photoresponsive device comprised of a substrate, a photogenerating layer, comprised of inorganic photoconductive composition, or an organic photoconductive composition, a charge carrier transport layer in contact with the photogenerating layer, which transport layer is comprised of electrically active molecules of the formula:

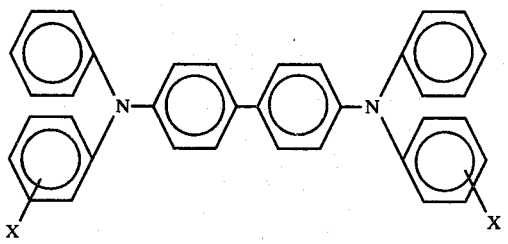

dispersed in a highly insulating and transparent organic resinous material, wherein X is selected from the group consisting of (ortho) $CH_3$, (meta) $CH_3$, (para) $CH_3$, (ortho) Cl, (meta) Cl, (para) Cl; and as a top coating in contact with the charge carrier transport layer, an arylmethane of the formula:

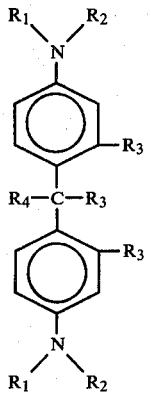

wherein $R_1$ and $R_2$ are independently selected from the group consisting of alkyl groups, aryl groups, alkylaryl groups and arylalkyl groups, $R_3$ is independently selected from the group consisting of hydrogen, and methyl, $R_4$ is independently selected from the group consisting of alkyl groups, alkylaryl groups, arylalkyl groups, and a disubstituted aminophenyl group, wherein the substituents are independently selected from the group consisting of alkyl, aryl, alkylaryl, and arylalkyl.

2. An improved photoresponsive device in accordance with claim 1 wherein the arylmethane is bis-(4-N,N-diethylamino-2-methylphenyl)phenylmethane.

3. An improved photoresponsive device in accordance with claim 2 wherein the bis-(4-N,N-diethylamino-2-methylphenyl)phenylmethane is dispersed in from about 25 percent by weight to about 95 percent by weight of a resinous binder.

4. An improved photoresponsive device in accordance with claim 3 wherein the resinous binder is a polycarbonate.

5. An improved photoresponsive device in accordance with claim 1 wherein the thickness of the substrate ranges from about 75 microns to about 1,500 microns, the thickness of the photogenerating layer ranges from about 0.1 microns to about 4 microns, the thickness of the charge transport layer ranges from about 3 microns to about 40 microns, and the thickness of the top coating ranges from about 0.1 microns to about 5 microns.

6. An improved photoresponsive device in accordance with claim 1 wherein the inorganic photoconductive material is amorphous selenium, trigonal selenium, or alloys of selenium tellurium, selenium arsenic, selenium tellurium arsenic.

7. An improved photoresponsive device in accordance with claim 1 wherein the organic photoconductive substance is a metal phthalocyanine or a metal free phthalocyanine.

8. An improved photoresponsive device in accordance with claim 1 wherein the metal phthalocyanine is copper phthalocyanine, and the metal free phthalocyanine is X metal free phthalocyanine.

9. An improved photoresponsive device in accordance with claim 1 wherein the organic photoconductive material is vanadyl phthalocyanine.

10. An improved photoresponsive device in accordance with claim 1 wherein the charge carrier transport layer is comprised of N,N'-diphenyl-N,N'-bis(3-methylphenyl)-[1,1'-biphenyl]-4,4'-diamine dispersed in a polycarbonate resinous binder.

11. An improved photoresponsive device in accordance with claim 10 wherein the polycarbonate resin is present in an amount of from about 25 percent by weight to about 80 percent by weight.

12. An improved photoresponsive device in accordance with claim 1 wherein the substrate is a conductive polymer.

13. An improved photoresponsive device in accordance with claim 1 wherein there is situated between the substrate and the photogenerating layer a blocking layer.

14. An improved photoresponsive device in accordance with claim 13 wherein the blocking layer is a phenoxy resin.

15. An improved photoresponsive device in accordance with claim 1 wherein adverse degradation of the photogenerating layer and charge carrier transport layer results from the presence of the top coating arylmethane layer.

16. An improved photoresponsive device in accordance with claim 11 wherein the molecular weight of the polycarbonate resin is from about 20,000 to about 100,000.

17. An improved photoresponsive device in accordance with claim 1 wherein the arylmethane is selected from the group consisting of bis-(4-N,N'-diethylamino-2-methylphenyl)phenylmethane, 1-bis-(4-N,N'-diethylaminophenyl-1-phenylethane, and bis-[(4-bis-N,N'-phenylmethyl)-amino-2-chlorophenyl]phenylmethane.

* * * * *